United States Patent [19]

Galindo

[11] Patent Number: 4,508,419

[45] Date of Patent: Apr. 2, 1985

[54] HYPODERMIC NEEDLE CONNECTOR

[76] Inventor: Anibal Galindo, 6500 Caballero Blvd., Coral Gables, Fla. 33146

[21] Appl. No.: 429,168

[22] Filed: Sep. 30, 1982

[51] Int. Cl.[3] ..... H01R 4/48

[52] U.S. Cl. ..... 339/256 S; 128/639; 128/642; 604/117; 604/174; 604/272

[58] Field of Search ..... 604/117, 174, 272–274; 128/303.18, 303.19, 639, 642, 784; 339/69, 256 S

[56] References Cited

U.S. PATENT DOCUMENTS

| | | | |
|---|---|---|---|
| 2,187,259 | 1/1940 | Barnhart | 604/117 |
| 3,078,850 | 2/1963 | Schein et al. | 128/784 X |
| 3,243,755 | 3/1966 | Johnson | 339/256 S |
| 3,432,803 | 3/1969 | Nice | 339/256 S |
| 3,477,437 | 11/1969 | Goldberg | 604/117 |
| 3,503,033 | 3/1970 | Kennedy | 339/256 S |
| 3,682,162 | 8/1972 | Colyer | 128/741 X |
| 4,354,728 | 10/1982 | DeLucia | 339/256 S |

FOREIGN PATENT DOCUMENTS

| | | | |
|---|---|---|---|
| 2515357 | 10/1976 | Fed. Rep. of Germany | 339/256 S |

*Primary Examiner*—Dalton L. Truluck
*Attorney, Agent, or Firm*—Eugene F. Malin

[57] ABSTRACT

A hypodermic needle connector including a needle holder for holding a hypodermic needle by a coil of wire and a wire connector that allows non-complex correction to a nerve electro finder lead wire for providing a positive electrical connection between the power source and the tip of a hypodermic needle. The wire connector includes mating a male and female wire coil portions. The hypodermic needle connector may also be used to limit the depth of penetration of a hypodermic needle shaft into the tissues by connecting the hypodermic needle into the smaller end of the needle holder. Further, the hypodermic needle connector may be connected to an EKG pad for convenient location by connecting the smaller end to the EKG pad. The hypodermic needle connector includes two parts of spring wound stainless steel wire with a first part having a needle holder, a link and a female mating connection and a second part, a male mating portion for connecting an electrical wire to the hypodermic needle.

6 Claims, 7 Drawing Figures

HYPODERMIC NEEDLE CONNECTOR

BACKGROUND OF THE INVENTION

A needle connector for holding a hypodermic needle and for electrically connecting the hypodermic needle to a nerve electro finder with a power source for locating nerves and for anesthetising nerves.

In the past there have been hypodermic needle guards of different sizes and shapes such as those disclosed in U.S. Pat. Nos. 2,110,123, 2,851,157 and 1,518,531. None of these old patent devices disclose the structure or teach the useful functions presently disclosed in this invention.

SUMMARY OF THE INVENTION

A hypodermic needle connector for physically holding a hypodermic needle and for electrically connecting the hypodermic needle to a nerve electro finder lead wire to provide a positive electrical connection between the tip of a hypodermic needle shaft and an electrical power source to locate nerves and to anesthetize them. The hypodermic needle connector may be inversely connected to the hypodermic needle to limit the depth of penetration of a hypodermic needle into the tissues of a patient to prevent the hypodermic needle shaft from breaking off at the hilt. Also, the hypodermic needle may be connectable to an EKG pad placed on a patient in order to hold the hypodermic needle connector.

The hypodermic needle connector includes two parts of spring wound stainless steel wire. The first part, a needle holder, includes a needle holding portion for holding a hypodermic needle in a plurality of positions and a female wire connection portion. The wire connector, a second part, a wire connector, that is a mating male wire connection portion.

The first part has a needle holder or a cylindrical needle connecting wire coil portion with an intermediate tapering generally conical wire coil portion that allows a needle body to be screwed into the large opening. By moving the needle body clockwise, the needle is tightened in its position and by moving the needle body counterclockwise it is released and easily removed from the holding position. When the needle is screwed into the small opening on the other end, the hypodermic needle hub and neck is held from contact with the tissues. The large end becomes a guard to limit the depth of penetration of the needle into the tissues. The guard holds the proximal end of the shaft or canula, where it meets the hub of the needle body, away from the skin. The hypodermic needle therefore acts as a control mechanism that prevents the needle from breaking off in the tissues at the proximal end of the shaft or canula and leaving no easy way to extract the broken needle if it had been inserted to its full length into the skin of a patient.

The spring-wound stainless steel wire provides a low cost material and design for a hypodermic needle holder. The coils can accommodate needle hubs of the same and different sizes and shapes and can be used in various positions and at other angles to hold the hypodermic needle in place.

One of the objects of this invention is to provide a noncomplex positive electrical connection for a lead wire to a hypodermic needle.

Another object of this invention is to provide an electrical connector that will limit the depth of penetration of the canula of a needle into the tissues.

Another object of this invention is to provide a hypodermic needle connector that is connectable to an EKG pad.

A further object of this invention is to provide an electrical connection that will hold the needle and at the same time will become a guard to limit the penetration of the needle canula into the tissues.

Still a further object of this invention is to provide an inexpensive, simple, durable safe and efficient needle connector that can accommodate needle hubs of different sizes and shapes and can be used in various positions and at other angles to lock the needle in place.

In accordance with these and other objects which will be apparent hereinafter, the instant invention will now be described with particular reference to the accompanying drawings.

DESCRIPTION OF THE PREFERRED EMBODIMENT

Figure 3:
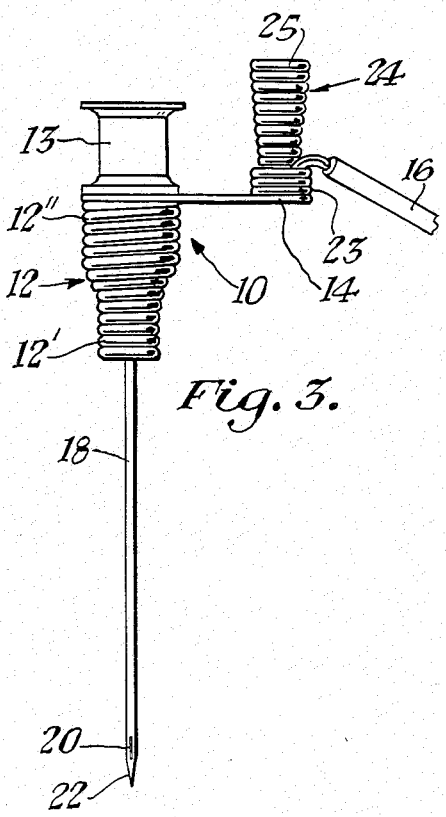
FIG. 3 is a side view of the hypodermic needle connector with a hypodermic needle and nerve electro finder wire.
Figure 2:
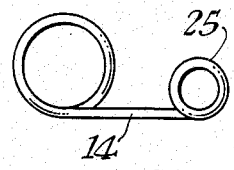
FIG. 2 is the top view of the upper coils of the hypodermic needle connector.
Figure 1:
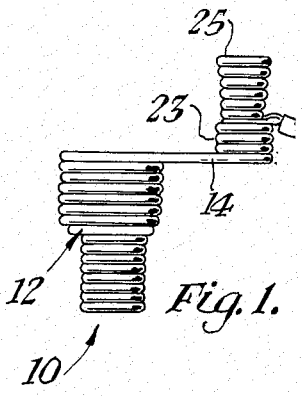
FIG. 1 is the side view of the hypodermic needle connector connected to a nerve electro finder wire.

Referring now to the drawing, FIGS. 1, 2 and 3, the hypodermic needle connector 10 is formed of coiled wire. The material is preferrably stainless steel wire. The hypodermic needle connector 10 includes a needle holder 12 including a needle portion 12″ or cylindrical needle connecting wire coil portion, an intermediate tapering conical wire coil portion connected to said needle portion 12″, a bulb connecting portion 12′ or small diameter cylindrical bulb connecting wire coil portion 12′ is connected to the smaller diameter of said tapering portion, a link portion 14 having one end connected to the larger diameter of said needle portion, and said mating portion 23 or female cylindrical wire connecting wire coil portion 23 connected to the other end of said link portion 14. The hypodermic needle connector 10 also includes a wire connector 24. The wire connector 24 includes the mating portion 23 and a separate member referred to as the other mating portion 25. The other mating portion 25 is a male tapering conical wire coil portion 25. The male portion 25 mates in said female portion 23 to electrically connect and secure a nerve electro finder lead wire 16 to the hypodermic needle hub 30 and shaft 18 for transmitting current into a patient.

The needle portion 12'' is a hub holder for holding the hypodermic needle hub 30. The hub 30 is pushed and turned into the needle portion 12''. The wire 16 is connected to wire connector 24 for positive electrical connection to the hypodermic needle. The female portion 23 is electrically linked by member or link 14 to the needle hub holder 12''. The male portion 25, as shown in FIGS. 1, 4 and 5 connects the nerve electro feeder wire 16 to the hypodermic needle with its upper portion 13, hub 30, neck 31, needle shaft 18, point 22 and opening 20 that allows anesthetic fluid to be dispensed adjacent a nerve after it is located through the use of electrical current placed in the needle shaft 18 and tip 22.

Figure 4:
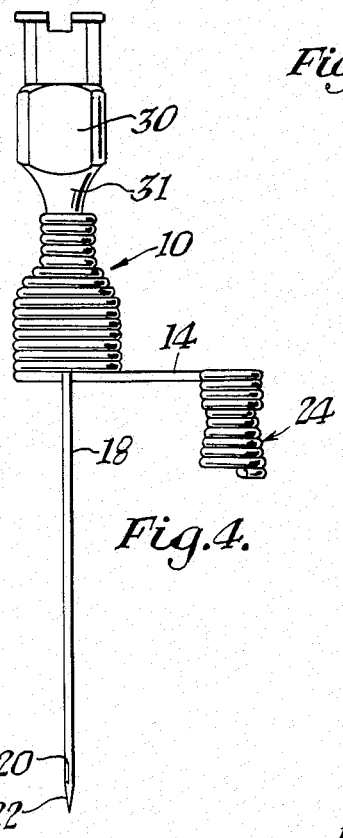
FIG. 4 is a side view of the hypodermic needle connector for limited penetration into a patient.
Figure 5:
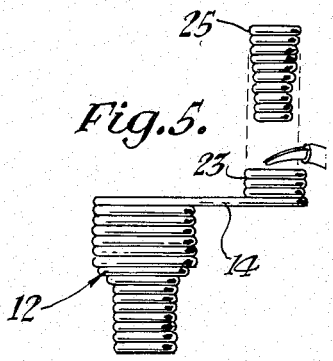
FIG. 5 is a side view of the hypodermic needle connector illustrating the male wire connection portion and the female wire connection portion in an exploded view.

The hypodermic needle connector 10 may also be used to limit the depth of penetration of a hypodermic needle shaft 18 on the end of the neck 31 of hub 30, see FIG. 4. The neck 31 of hub 30 is inserted into hub connection portion 12' of the needle holder 12. The larger needle holder 12'' limits the penetration of the shaft or canula 18 into the body tissues of the patient by separating the neck 31 from the end of needle holder 12'' at link 14 as shown in FIG. 4. To prevent the shaft or canula 18 from breaking off in the body tissues and leaving the needle at skin level or below skin level which is an irretrievable position, the hypodermic needle is attached as shown in FIG. 4.

Figure 6:
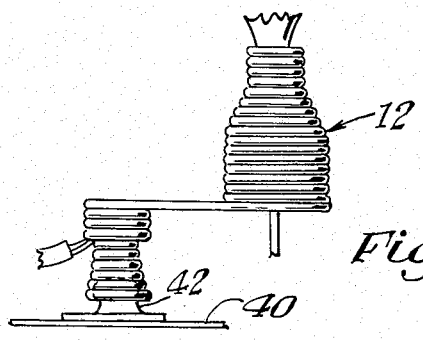
FIG. 6 is a side view of the hypodermic needle connector connected to an EKG pad.

The bulb connecting portion 12' is connectable to an EKG pad 40 as shown in FIG. 6. The pad 40 has a bulbous member 42 connected to the pad 40. The distal end of male or other mating portion 25 is snapped onto the bulbous member 42.

Figure 7:
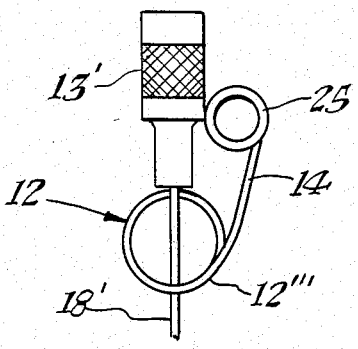
FIG. 7 is a top view of the upper coils of the hypodermic needle connector with the needle passing transversely through the cylindrical coil portion.

It should be noted that when a needle such as 13' in FIG. 7 is used and does not fit into needle holder 12 as shown in FIG. 3, the shaft or canula 18' may be electrically connected by transversely passing the needle through coil 12''' as shown.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hypodermic needle connector comprising:

a wire connector including a needle holder, a link and connector, and said needle holder including a needle portion for releasably holding a hypodermic needle, said link connected to said needle portion, said connector including a mating portion connected to said link and another mating portion connected to said mating portion of said wire connector portion for releasably connecting and securing a nerve electro finder lead wire to said hypodermic needle connector for transmitting current to the hypodermic needle.

2. A hypodermic needle connector as set forth in claim 1, wherein:

said another mating portion includes a bulb connecting portion for connecting said hypodermic needle connector to an EKG pad.

3. A hypodermic needle connector as set forth in claim 1, wherein:

said needle portion, said mating portion and said another mating portion are wire coils.

4. A hypodermic needle connector as set forth in claim 2, wherein:

said needle portion, said mating portion, said another mating portion, and said bulb portion are wire coils.

5. A hypodermic needle connector as set forth in claim 4, wherein:

said needle portion includes a cylindrical needle connecting wire coil portion, an intermediate tapering conical wire coil portion connected to said needle portion.

a small diameter cylindrical bulb connecting wire coil portion conneted to said tapering conical wire coil portion, said link having one end connected to said cylindrical needle connecting wire coil portion of said needle portion, said mating portion is a female cylindrical wire connecting wire coil portion connected to the other end of said link portion, and said another mating portion is a male tapering conical wire coil portion, said male portion mates in said female portion to electrically connect and secure a nerve electro finder lead wire to said hypodermic needle connector for transmitting current.

6. A hypodermic needle connector comprising:

a wire connector including a needle holder, a link and connector, and said needle holder including a needle portion for releasably holding a hypodermic needle, said link connected to said needle portion, said connector including a mating portion connected to said link and another mating portion connected to said mating portion of said wire connector portion for releasably connecting and securing a nerve electro finder lead wire to said hypodermic needle connector for transmitting current to the hypodermic needle, said another mating portion includes a bulb connecting portion for connecting said hypodermic needle connector to an EKG pad, said needle portion, said mating portion, said another mating portion, and said bulb portion are wire coils.

said needle portion includes a cylindrical needle connecting wire coil portion, an intermediate tapering conical wire coil portion connected to said needle portion, a small diameter cylindrical bulb connecting wire coil portion conneted to said tapering conical wire coil portion, said link having one end connected to said cylindrical needle connecting wire coil portion larger diameter of said needle portion, said mating portion is a female cylindrical wire connecting wire coil portion connected to the other end of said link portion, and said another mating portion is a male tapering conical wire coil portion, said male portion mates in said female portion to electrically connect and secure a nerve electro finder lead wire to said hypodermic needle connector for transmitting current.

* * * * *